US011346137B2

(12) United States Patent
Schiffer

(10) Patent No.: US 11,346,137 B2
(45) Date of Patent: May 31, 2022

(54) ELECTRIC LOCK COMPRISING ACTUATING DEVICE FOR A MOTOR VEHICLE LOCK

(71) Applicant: Kiekert AG, Heiligenhaus (DE)

(72) Inventor: Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 1071 days.

(21) Appl. No.: 15/751,899

(22) PCT Filed: Jul. 26, 2016

(86) PCT No.: PCT/DE2016/100337
§ 371 (c)(1),
(2) Date: Mar. 16, 2018

(87) PCT Pub. No.: WO2017/025082
PCT Pub. Date: Feb. 16, 2017

(65) Prior Publication Data

US 2018/0230716 A1 Aug. 16, 2018

(30) Foreign Application Priority Data

Aug. 13, 2015 (DE) ..... 10 2015 113 359.8

(51) Int. Cl.
*E05B 77/10* (2014.01)
*E05B 81/14* (2014.01)
(Continued)

(52) U.S. Cl.
CPC ..... *E05B 77/10* (2013.01); *E05B 81/14* (2013.01); *E05B 79/20* (2013.01); *E05B 81/06* (2013.01); *E05B 81/34* (2013.01)

(58) Field of Classification Search
CPC ..... E05B 77/10; E05B 81/14; E05B 79/20; E05B 81/06; E05B 81/34
See application file for complete search history.

(56) References Cited

U.S. PATENT DOCUMENTS 6,463,773 B1 * 10/2002 Dimig ..... E05B 83/36 292/201

FOREIGN PATENT DOCUMENTS

DE 197 10 531 A1 9/1998
DE 19710531 A1 * 9/1998 ..... E05B 77/12
(Continued)

OTHER PUBLICATIONS

International Search Report and Written Opinion for corresponding Patent Application No. PCT/DE2016/100337 dated Nov. 7, 2016.

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

The aim of the invention is to be able to constantly open a locking mechanism of an electrically actuated lock of a motor vehicle with sufficiently large force, without having to provide an excessively large electric motor and/or an excessively large gearing transmission ratio for this purpose. In order to solve the problem, a lock for a motor vehicle comprises a locking mechanism (3) and an actuator device for opening the locking mechanism (3). The actuation device comprises a rotatable actuator (1) which can be rotated by a motorised drive (15), in particular by an electric drive. A rotating of the actuator (1) brings about an unlocking, i.e. an opening, of the locking mechanism (3). The locking mechanism (3) can be opened independently of the direction of rotation of the actuator (1). Opening of the locking mechanism (3) is therefore not dependent upon a defined direction of rotation. The force with which the locking mechanism (3) is opened depends on the direction of rotation of the actuator (1). Opening can therefore be achieved with different force depending on the direction of rotation. In this way, in regular operation opening is possible with a lower force compared to a case requiring a greater force for opening. In regular
(Continued)

Figure 1:
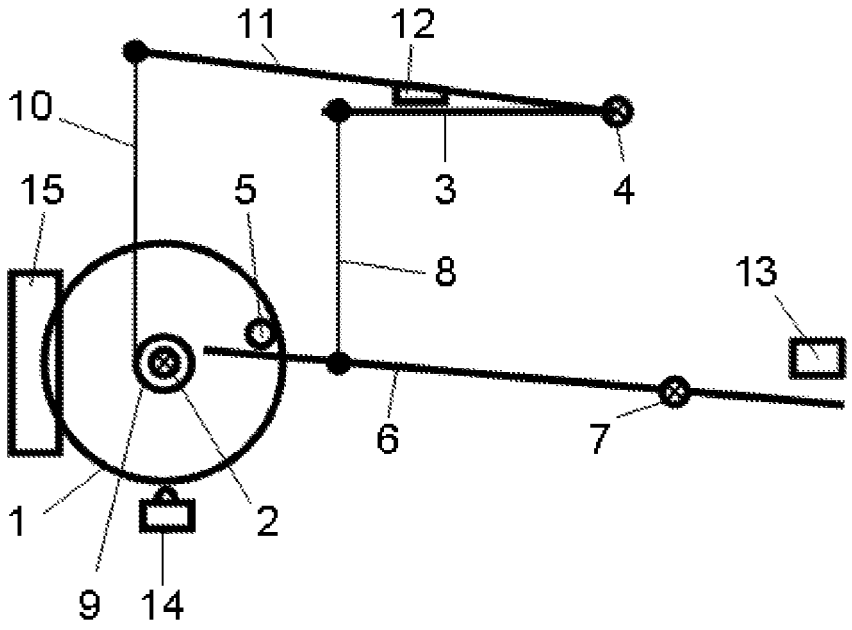

operation, in which a conventional force is used for opening the locking mechanism (3), opening is achieved quickly and with low expenditure of energy. However, it is still possible, if necessary, albeit with delay, to be able to open with greater force for this purpose.

14 Claims, 1 Drawing Sheet

(51) Int. Cl.

| | |
|---|---|
| *E05B 79/20* | (2014.01) |
| *E05B 81/06* | (2014.01) |
| *E05B 81/34* | (2014.01) |

(56) References Cited

FOREIGN PATENT DOCUMENTS

| | | | | | |
|---|---|---|---|---|---|
| DE | 10328475 | A1 | | 1/2005 | |
| DE | 10 2006 051884 | A1 | | 5/2008 | |
| DE | 10 2009 026 921 | A1 | | 12/2010 | |
| DE | 1021100778 | | * | 4/2011 | ..... B60N 2/20 |
| DE | 10 2011 007778 | A1 | | 10/2012 | |
| DE | 102014001160 | A1 | | 8/2015 | |
| EP | 1 074 681 | A1 | | 2/2001 | |
| EP | 2 826 938 | A2 | | 1/2015 | |
| WO | 2010/142280 | A1 | | 12/2010 | |
| WO | 2016/078639 | A1 | | 5/2016 | |

* cited by examiner

ELECTRIC LOCK COMPRISING ACTUATING DEVICE FOR A MOTOR VEHICLE LOCK

The invention relates to a latch for a door or a flap of a motor vehicle with an operating device.

Such a latch has a locking mechanism in principle comprising a catch and a pawl for ratcheting of the catch in a ratchet position and optionally a blocking lever for blocking of the pawl in its ratchet position. Such a latch is known from DE 102009026921 A1.

The purpose of the operating device is to open the door or flap and it therefore enables unratcheting of the locking mechanism. By means of operation of the operating device, the pawl is moved out of its ratchet position and, if necessary, the blocking lever is moved out of its blocking position and the locking mechanism is finally opened. The door or flap can subsequently be opened.

The operating device usually has a triggering lever which is operated in order to open or unratchet the locking mechanism. Such a triggering lever is typically connected to a door or flap handle. This can be an external or internal handle of a relevant door or flap. If such a handle is operated, the triggering lever is operated or pivoted to unratchet the locking mechanism and thus to open the latch.

With electrically operated latches, no mechanical connection exists between the door handle, for example an external door handle, and the locking mechanism. The locking mechanism is opened by means of an electrical drive. A pertaining door handle can have an electrical switch, for example, which provides the signal for the drive of the electromotor. Wormgear wheel gearboxes consisting of a motor, a wormgear and a gearwheel are preferably used as this can achieve a great transmission ratio so that, on the one hand, very accurate control of the opening mechanism can occur and, at the same time, high triggering forces are available.

In extreme cases or under unfavorable weather conditions it can occur that much greater forces act on the locking mechanism so that a customary triggering mechanism cannot provide sufficiently great force to open the locking mechanism. Such a case can occur, for example, if the motor vehicle door has been deformed by an accident or, for example, if increased forces are required to open the locking mechanism due to extreme weather impacts, such as cold weather.

It is an object of the invention to reliably be able to open a locking mechanism of an electrically operated latch of a motor vehicle with sufficient force without needing to provide an electromotor with excessive dimensions for standard operation and/or an excessively dimensioned gearbox transmission ratio.

The object is solved by a latch with the characteristics of the first claim. Advantageous embodiments arise from the sub claims.

In order to solve the object, a latch for a motor vehicle encompasses a locking mechanism and an operating device to open a locking mechanism. The operating device encompasses a rotatable actuator which can be rotated by a motorized drive, in particular by an electrical drive. Rotation of the actuator causes unratcheting, i.e. opening, of the locking mechanism. The locking mechanism can be opened independently of the rotational direction of the actuator. It does not therefore depend on a certain rotational direction to open the locking mechanism. Every possible rotational direction therefore causes opening of the locking mechanism. The force with which the locking mechanism is opened depends on the rotational direction of the actuator. It can be opened with forces of different magnitudes dependent on the rotational direction. This enables opening with a lesser force in standard operation compared to the case which requires greater force for opening. In standard operation in which a customary force is sufficient to open the locking mechanism, opening can take place quickly and with little energy expenditure. However, the possibility exists of opening with greater force, but in a delayed manner if necessary.

In one configuration, the locking mechanism is opened by means of a pulling means in one rotational direction in particular by means of a rope winch. The rope winch is in particular arranged close to the axis of the rotatable actuator in order to be able to provide a lever ratio with great transmission and thus great force. The actuator is then driven by a drive in particular on its external circumference and in particular by an electromotor in addition to a gearbox. The external circumference can be configured as a gearwheel which is driven by a gearwheel of the gearbox or by means of a wormgear of the drive. A reliably functioning drive can thus be ensured. Instead of a rope winch, however, solely a rope or a rod can also be connected to the actuator. A pulling movement for opening of the locking mechanism is transmitted by means of this rope or this rod. The rope or the rod are also advantageously arranged close to the axis in order to enable a lever ratio which enables opening of the locking mechanism with great force.

The pulling means is in particular attached to the free end of the transmission means in order to enable a better lever ratio by means of which the locking mechanism can be opened with great force.

In one configuration, the transmission lever encompasses a tappet arranged between the free end of the transmission lever on which the pulling means is attached and the rotational axis of the transmission lever. By means of this tappet, a pivoting movement of the transmission lever can be transmitted to a pawl and the pawl can thus be moved out of its ratchet position. The arrangement of the tappet also enables the pawl being able to be moved out of its ratchet position with great force due to relevant lever ratios. The tappet is arranged in particular in the first half of the transmission lever seen from the axis by means of which the transmission lever is rotatably accommodated. In a further improved manner, a lever ratio is hereby provided which enables opening with great force.

In one configuration, the rotation of the actuator pivots a triggering lever in a rotational direction which is capable of opening with little force by pivoting of the locking mechanism. This configuration contributes to opening being able to take place with forces of very different magnitudes. The actuator can encompass a bolt which is preferably arranged peripherally in order to be able to open especially quickly.

The stated configurations enable opening with different forces and different speeds without providing an excessively large construction space or needing to operate with an excessively large technical effort. It is possible in particular that the lesser force is different many times over to the higher force without needing to operate an excessively large technical effort. The lesser force can be provided very quickly.

It is possible that the greater force is at least four times, preferably at least six times, larger than the lesser force. Thus, in one embodiment the lesser force is up to 16 Newtons. The greater force is at least 80 Newtons, advantageously at least 100 Newtons. A very great force is thus present in order to also be able open a latch in exceptional situations. Opening can occur very quickly for standard operation which only requires a lesser force.

In principle, the locking mechanism of the latch according to the invention encompasses a catch and a pawl for ratcheting of the catch and optionally also a blocking lever which is capable of blocking the pawl in its ratchet position.

The latch is an electrically operable latch in particular.

Figure 2:
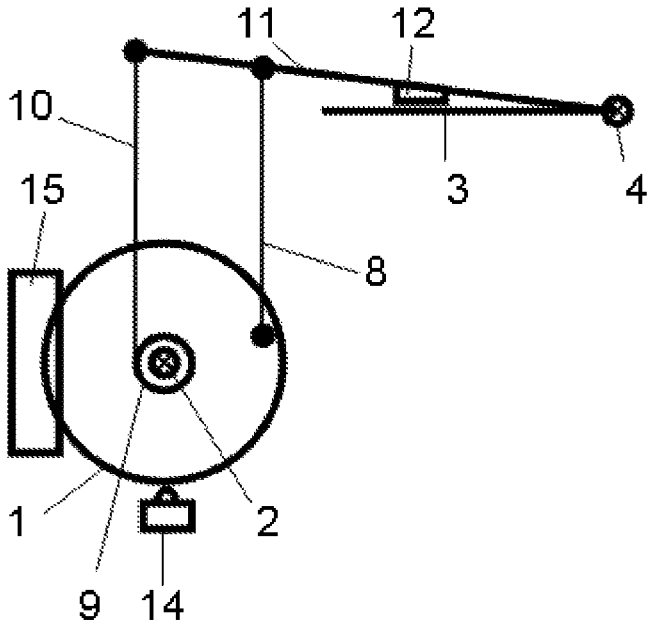

The invention is explained in further detail hereafter on the basis of figures. The following are shown:

FIG. 1 Operating device with two levers for unratcheting of a pawl of a locking mechanism;

FIG. 2 Operating device with a lever for unratcheting of a pawl of a locking mechanism;

FIG. 1 shows an operating device with which a pawl can be opened as an example. An actuator 1 is shown which can fundamentally be a wheel or a disk pivotably accommodated by an axis 2. By rotating the actuator 1 a pawl 3 can be moved out of its ratchet position, namely by rotation in an anti-clockwise direction around its axis 4. The force with which the pawl 3 is moved out of its ratchet position depends on the rotational direction of the actuator 1. If the actuator 1 is pivoted in a clockwise direction around its axis 2, an actuator bolt 5 attached at the edge of the wheel thus grasps a lever end of a triggering lever 6 and thus pivots the triggering lever 6 in an anti-clockwise direction around its axis 7. The actuator bolt therefore acts as a tappet. This pivoting movement of the triggering lever 6 is transmitted to the pawl 3, for example due to rodding 8 which is attached on the one hand to the triggering lever 6 and on the other hand to the free end of the pawl 3. Instead of rodding 8 a rod or similar can also be provided which connects or couples the triggering lever 6 and the pawl 3 such that a pivoting movement of the triggering lever 6 is transmitted to the pawl 3.

The actuator 1 has a rope winch 9, which is arranged on the axis 2. If the actuator 1 is rotated in an anti-clockwise direction, the rope 10 is wound onto the rope winch 9. One end of the rope 10 is connected to the end of a transmission lever 11. The transmission lever 11 is rotatably accommodated by the axis 4. The pawl 3 and the transmission lever 11 are therefore pivotably accommodated by a common axis 4. If the rope 10 is wound on, the transmission lever 11 is pivoted around the axis 4 in an anti-clockwise direction. This pivoting movement of the transmission lever 11 is transmitted to the pawl 3 by means of a tappet 12 of the transmission lever 11. The tappet 12 is arranged within the first half of the transmission lever 11 viewed from the axis 4 in the direction of the attachment for the pulling means 10. The pawl 3 is moved out of its ratchet position by the tappet 12, namely with significantly greater force compared to the force which acts on the pawl 3 when the actuator 1 is rotated in a clockwise direction.

Pivoting movements of the lever can be suitably limited by stops. A stop 13 is shown as an example in FIG. 1 which limits a pivoting movement of the triggering lever 6 in an anti-clockwise direction.

The respective position of the operating device can be monitored or detected by one or several sensors. A microswitch 14 with which the position of the actuator 1 can be detected is shown as an example in FIG. 1. In return, on the edge of the actuator, one or several elevations can be provided for which operate the microswitch or alternatively several microswitches and can thus display the position of the actuator. One or several sensors can be used to control and/or monitor the opening. A lesser force is initially used for opening in principle as an example. If it is ascertained by means of the one or several sensors that the pawl 3 could not be moved out of its ratchet position with the lesser force, a greater force is subsequently used for opening by the actuator 1 then being rotated in the opposite direction. A non-illustrated control device is present in principle which controls opening in the pre-stated manner.

The actuator 1 can be rotated around its axis 2 by an electrical drive 15, namely in both directions. The electrical drive 15 generally encompasses an electromotor which is capable of driving the actuator 1 by means of a gearbox. The actuator 1 can be a gearwheel which is driven by means of a further gearwheel or a wormgear of the electrical drive 15.

The embodiment according to FIG. 1 enables relatively rapid opening in the normal case, for example with 16 N. If this force proves to be insufficient, a force of 100 N and more can be provided subsequently by reverse rotation in order to be able to open the latch with sufficient force in a time-delayed, but reliable, manner.

One or several levers can be pre-tensioned by non-illustrated springs, thus, for example, the pawl 3 by a spring in the direction of its ratchet position and/or the transmission lever 11 by a spring in the direction of its starting position, from where opening of the locking mechanism can be pivoted for opening of the locking mechanism.

FIG. 2 shows an alternative embodiment with only one transmission lever 11. This transmission lever 11 is connected on the edge with the wheel of the actuator 1 by means of a further rope. The axis 2 of the actuator 1 is arranged between the two ropes 8 and 10 such that the transmission lever 11 is either pivoted by rope 8 or rope 10 dependent on the rotational direction of the actuator 1. The rope 8 can be attached by means of a second rope winch which reaches to the circumference of the actuator 1 wheel. The attachment or rope winch for the rope 8 is attached to the reverse of the actuator 1 if advantageous for reasons relating to construction space. A flexible belt or a rod or rodding can also be provided, for example, instead of a rope.

The embodiment according to FIG. 2 encompasses fewer components compared to the embodiment according to FIG. 1 and is thus of a simpler technical construction. However, the embodiment of FIG. 1 enables greater differences in force and in this regard has a crucial advantage compared to the embodiment according to FIG. 2.

LIST OF REFERENCE SYMBOLS

1: Actuator
2: Actuator axis
3: Pawl
4: Pawl axis
5: Actuator tappet; actuator bolt
6: Triggering lever
7: Axis of the triggering lever
8: Rod, rope
9: Rope winch
10: Rope of the rope winch
11: Transmission lever
12: Tappet of the transmission lever
13: Stop
14: Microswitch
15: Electrical drive

The invention claimed is:

1. A latch for a motor vehicle, the latch comprising:

a locking mechanism, a rotatable actuator configured to be pivoted by a drive, whereby the locking mechanism is configured to be opened by rotation of the rotatable actuator, wherein the locking mechanism is opened independently of rotational directions of the rotatable actuator, wherein the force with which the locking mechanism is opened depends on the rotational direction of the rotatable actuator, wherein the rotatable actuator opens the locking mechanism with a first force when the rotatable actuator rotates in a first direction of rotation, wherein the locking mechanism is opened by a pulling means in the first direction of rotation of the rotatable actuator, and wherein the rotatable actuator opens the locking mechanism with a second force that is smaller than the first force when the rotatable actuator rotates in a second direction of rotation that is opposite the first direction of rotation.

2. The latch according to claim 1, wherein the pulling means encompasses a rope or a rod or is a rope winch.

3. The latch according to claim 2, wherein the rope winch or an attachment for the rope or the rod is arranged about the axis of the rotatable actuator.

4. The latch according to claim 1, wherein the pulling means is connected to a transmission lever which is capable of transmitting its pivoting movement to a pawl of the locking mechanism for opening.

5. The latch according to claim 4, wherein the pulling means is attached at the free end of the transmission lever.

6. The latch according to claim 4, wherein the transmission lever encompasses a tappet by which a pivoting movement of the transmission lever is transmitted to the pawl for opening of the locking mechanism.

7. The latch according to claim 6, wherein the tappet is arranged between the free end of the transmission lever on which the pulling means is attached and the axis, by which the transmission lever is pivotably accommodated.

8. The latch according to claim 1, wherein the force supplied by the rotatable actuator in a first rotational direction is at least four times greater than the force supplied by the rotatable actuator in a second rotational direction opposite to the first rotational direction.

9. The latch according to claim 1, wherein by rotation of the rotatable actuator in a rotational direction a triggering lever is pivoted which is capable of opening the locking mechanism by pivoting with little force.

10. The latch according to claim 9, wherein the rotatable actuator encompasses a bolt that is configured to pivot the triggering lever.

11. The latch according to claim 10, wherein the bolt is arranged on an external edge of the rotatable actuator.

12. The latch according to claim 10, further comprising an electrical drive that is configured to drive the rotatable actuator.

13. The latch according to claim 1, wherein the locking mechanism encompasses a catch and a pawl for ratcheting of the catch.

14. The latch according to claim 1, wherein the latch is an electrically operated latch.

* * * * *